US009938814B2

(12) United States Patent
Hay

(10) Patent No.: US 9,938,814 B2
(45) Date of Patent: Apr. 10, 2018

(54) DISPLACEABLE COMPONENTS IN DRILLING OPERATIONS

(75) Inventor: Richard T. Hay, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 290 days.

(21) Appl. No.: 14/412,638

(22) PCT Filed: Jul. 5, 2012

(86) PCT No.: PCT/US2012/045547

§ 371 (c)(1),
(2), (4) Date: Jan. 2, 2015

(87) PCT Pub. No.: WO2014/007824

PCT Pub. Date: Jan. 9, 2014

(65) Prior Publication Data

US 2015/0152723 A1 Jun. 4, 2015

(51) Int. Cl.
*E21B 12/00* (2006.01)
*E21B 10/00* (2006.01)
(Continued)

(52) U.S. Cl.
CPC ..... *E21B 44/005* (2013.01); *E21B 10/00* (2013.01); *E21B 10/62* (2013.01); *E21B 12/00* (2013.01); *E21B 17/1014* (2013.01); *E21B 17/1092* (2013.01); *E21B 47/01* (2013.01); *E21B 47/09* (2013.01); *E21B 47/12* (2013.01); *E21B 49/003* (2013.01)

(58) Field of Classification Search
None
See application file for complete search history.

(56) References Cited

U.S. PATENT DOCUMENTS 5,199,497 A * 4/1993 Ross ..... E21B 23/00 148/402
6,142,250 A 11/2000 Griffin et al.
(Continued)

FOREIGN PATENT DOCUMENTS

WO 2012/138827 10/2012

OTHER PUBLICATIONS

Extended European Search Report for European Application No. 12880674.2, dated Aug. 10, 2016; 7 pages.
(Continued)

*Primary Examiner* — Shane Bomar
(74) *Attorney, Agent, or Firm* — Baker Botts L.L.P.

(57) ABSTRACT

A well drilling system can include a drilling tool with at least one component which is displaced by a material that changes shape. The material can be a shape memory material. The material may change shape in response to a temperature change. The component can be a drill bit cutter, a depth of cut control surface, a gauge surface or a stabilizer surface. A method of controlling a drilling operation can include configuring a drilling tool with a material which changes shape, and the material displacing at least one component of the drilling tool during the drilling operation. Displacement of the component can be controlled downhole to maintain drilling parameters (such as torque, vibration, steering performance, etc.) in desired ranges.

26 Claims, 7 Drawing Sheets

(51) Int. Cl.

| | |
|---|---|
| ***E21B 44/00*** | (2006.01) |
| ***E21B 47/01*** | (2012.01) |
| ***E21B 10/62*** | (2006.01) |
| ***E21B 17/10*** | (2006.01) |
| ***E21B 47/09*** | (2012.01) |
| ***E21B 47/12*** | (2012.01) |
| ***E21B 49/00*** | (2006.01) |

(56) References Cited

U.S. PATENT DOCUMENTS

| | | | | |
|---|---|---|---|---|
| 6,216,779 | B1 * | 4/2001 | Reinhardt | E21B 17/1021 166/241.5 |
| 7,802,637 | B2 * | 9/2010 | Aronstam | E21B 7/062 175/266 |
| 7,931,098 | B2 | 4/2011 | Aronstam | |
| 8,104,548 | B2 * | 1/2012 | Ma | E21B 7/06 175/61 |
| 2004/0089477 | A1 * | 5/2004 | Moody | E21B 17/1021 175/61 |
| 2005/0056463 | A1 | 3/2005 | Aronstam et al. | |
| 2007/0227775 | A1 | 10/2007 | Ma et al. | |
| 2009/0044979 | A1 | 2/2009 | Johnson et al. | |
| 2009/0065262 | A1 * | 3/2009 | Downton | E21B 7/064 175/393 |
| 2010/0071962 | A1 | 3/2010 | Beuershausen | |
| 2011/0031025 | A1 * | 2/2011 | Kulkarni | E21B 10/62 175/76 |
| 2011/0147089 | A1 | 6/2011 | Kulkarni et al. | |
| 2012/0255784 | A1 * | 10/2012 | Hanford | E21B 10/62 175/57 |

OTHER PUBLICATIONS

Office Action received for Canadian Application No. 2878397, dated Mar. 11, 2016; 4 pages.

International Preliminary Report on Patentability issued in PCT/US2012/045547; 15 pages, dated Jan. 15, 2015.

International Search Report and Written Opinion, Application No. PCT/US2012/045547, 19 pages, dated Feb. 28, 2013.

* cited by examiner

FIG.3A
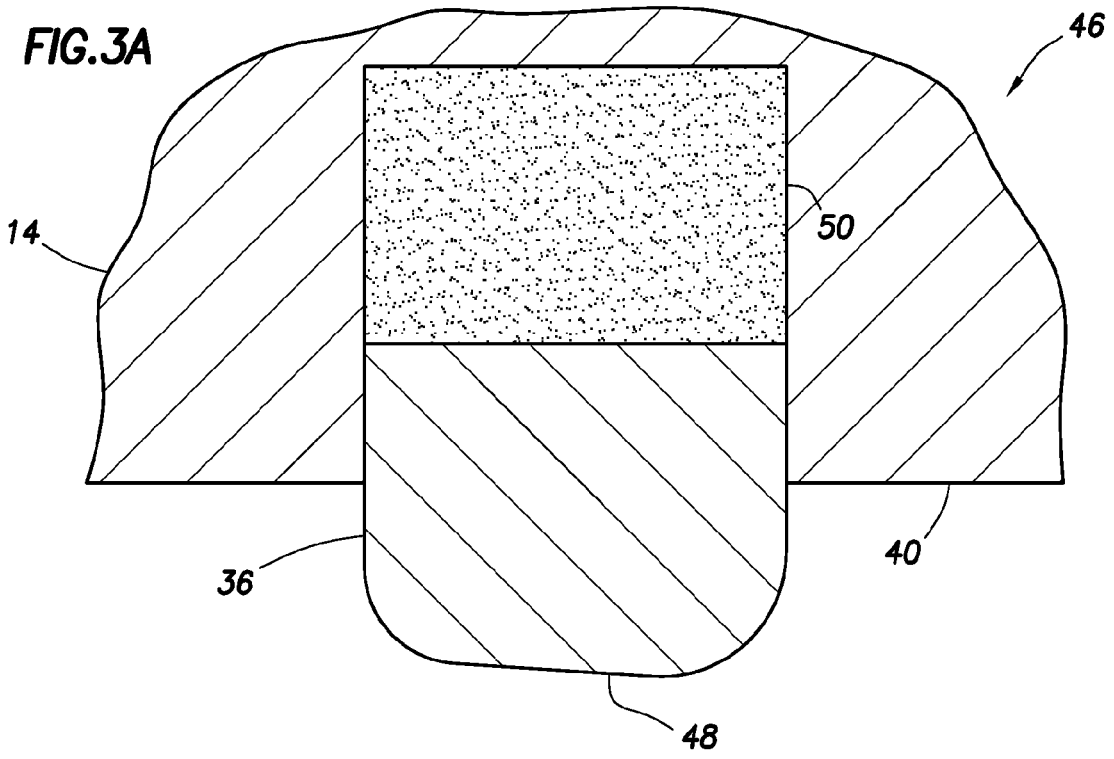
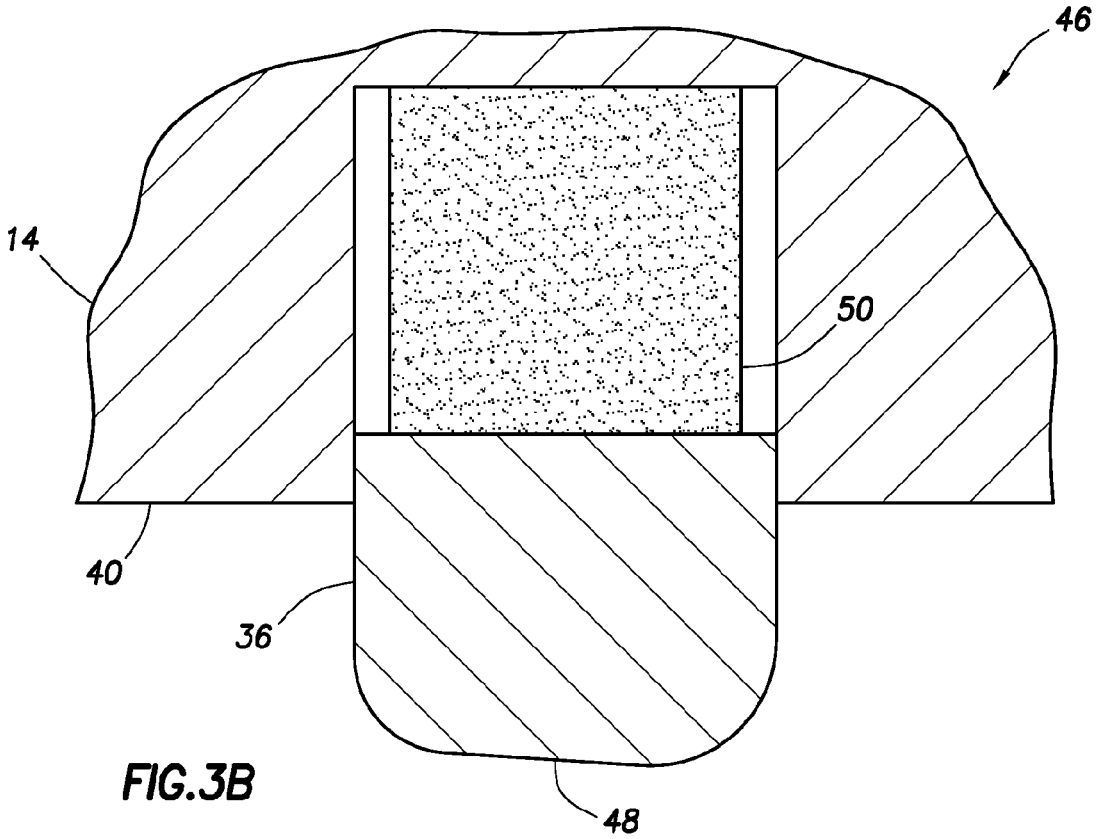
FIG.3B

FIG.4A
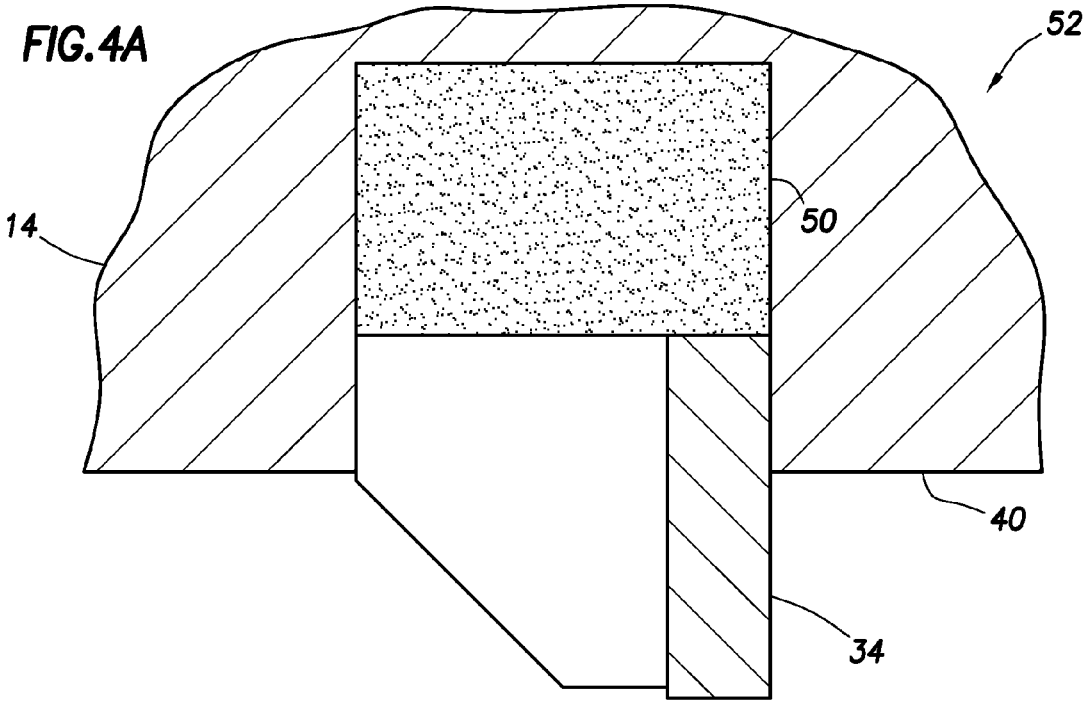
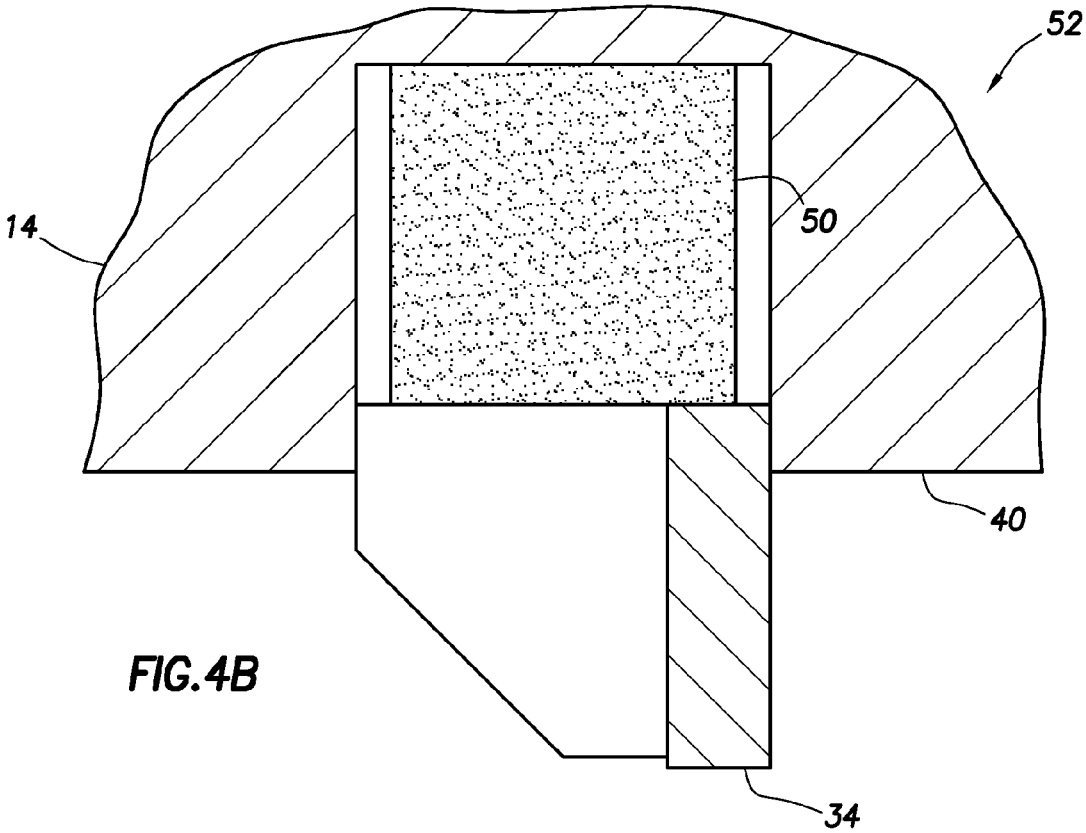
FIG.4B

DISPLACEABLE COMPONENTS IN DRILLING OPERATIONS

RELATED APPLICATIONS

This application is a U.S. National Stage Application of International Application No. PCT/US2012/045547 filed Jul. 5, 2012, which designates the United States, and which is incorporated herein by reference in its entirety.

TECHNICAL FIELD

This disclosure relates generally to equipment utilized and operations performed in conjunction with subterranean wells and, in one example described below, more particularly provides for displacing components of drilling tools in drilling operations.

BACKGROUND

Typically, drill string tools (such as drill bits, etc.) have fixed shapes while they are used in drilling operations. This means that these tools cannot be reshaped or reconfigured downhole as the drilling operations proceed. However, conditions downhole frequently do change during drilling operations.

Therefore, it will be appreciated that improvements are needed in the art of drill string tool design.

BRIEF DESCRIPTION OF THE DRAWINGS

FIGS. 3A & B are enlarged scale representative views of a depth of cut control device which may be incorporated into the drill bit.

FIGS. 4A & B are representative views of a cutter displacement device which may be incorporated into the drill bit.

DETAILED DESCRIPTION

Figure 1:
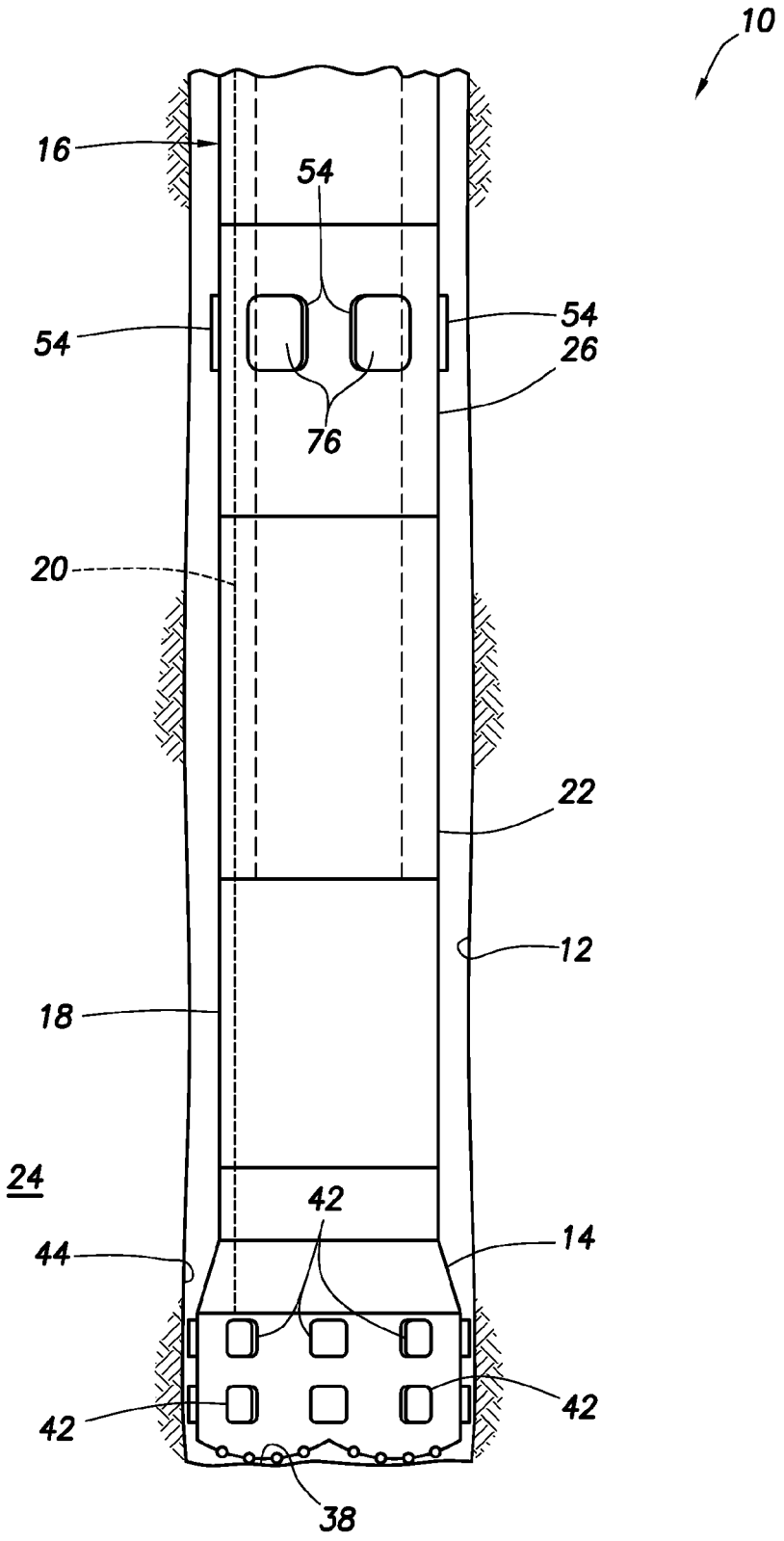
FIG. 1 is a representative partially cross-sectional view of a well drilling system and associated method which can embody principles of this disclosure.

Representatively illustrated in FIG. 1 is a well drilling system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is being drilled by rotating a drill bit 14 at an end of a generally tubular drill string 16. The drill bit 14 may be rotated by rotating the drill string 16 from the earth's surface (e.g., using a rotary table or top drive, etc.), by means of a fluid motor 18 (such as, a Moineau-type positive displacement motor or a turbine-type motor, etc.), and/or by any other suitable means.

In other examples, the wellbore 12 could be drilled by delivering impacts to the drill bit 14 (e.g., using a hammer drill, etc.), or using another suitable technique. Any manner of drilling the wellbore 12 may be used, in keeping with the scope of this disclosure.

The drill string 16 can include sensors 22 (such as, measurement-while-drilling sensors, logging-while-drilling sensors, a pressure-while-drilling sensor, an at-bit inclination sensor, an at-bit gamma ray sensor, etc.). These sensors 22 are well known to those skilled in the art. The sensors 22 may be capable of sensing any drilling parameters, such as torque, rate of penetration, weight on bit, vibration, acoustic signals, drilling force, bend, azimuthal direction, axial force, formation 24 resistivity, formation magnetic resonance, formation dip, drill string 16 inclination, formation density, other formation characteristics, rotational speed, pressure, temperature, etc.

The drill string 16 can have lines 20 extending longitudinally through the drill string (for example, in a wall of the drill string, in an internal flow passage of the drill string, etc.). The lines 20 can include electrical conductors, optical waveguides, hydraulic lines, or any other types of lines.

Alternatively (or in addition), the drill string 16 may comprise a "pipe-in-pipe" system, in which inner and outer tubular strings are provided. The separate tubular strings can serve as conductors for communicating power, data, commands and/or other signals between the drill bit 14 and a remote location (such as, the earth's surface, a subsea location, a remote control/monitoring facility, a floating rig, etc.). The drill string 16 may be made of any material or combination of materials (such as, metal, non-metal, composite, plastic, coiled tubing, jointed pipe, etc.).

The drill bit 14 is merely one example of a drilling tool which can embody the principles of this disclosure. Another type of drilling tool which can embody the principles of this disclosure is a drilling stabilizer 26.

The drilling stabilizer 26 may be used to mitigate undesired vibration of the drill string 16 in the wellbore 12 when/if the drill string rotates in the wellbore. However, the drilling stabilizer 26 can also (or alternatively) be used to steer the drill bit 14 in directional drilling, as described more fully below in regard to the example depicted in FIG. 7.

More detailed examples of the drill bit 14 and drilling stabilizer 26 are described below. It should be clearly understood, however, that other types of drilling tools can embody the principles of this disclosure, and so the scope of this disclosure is not limited at all to the details of the drill bit 14 and stabilizer 26 examples described here and/or depicted in the drawings.

Figure 2:
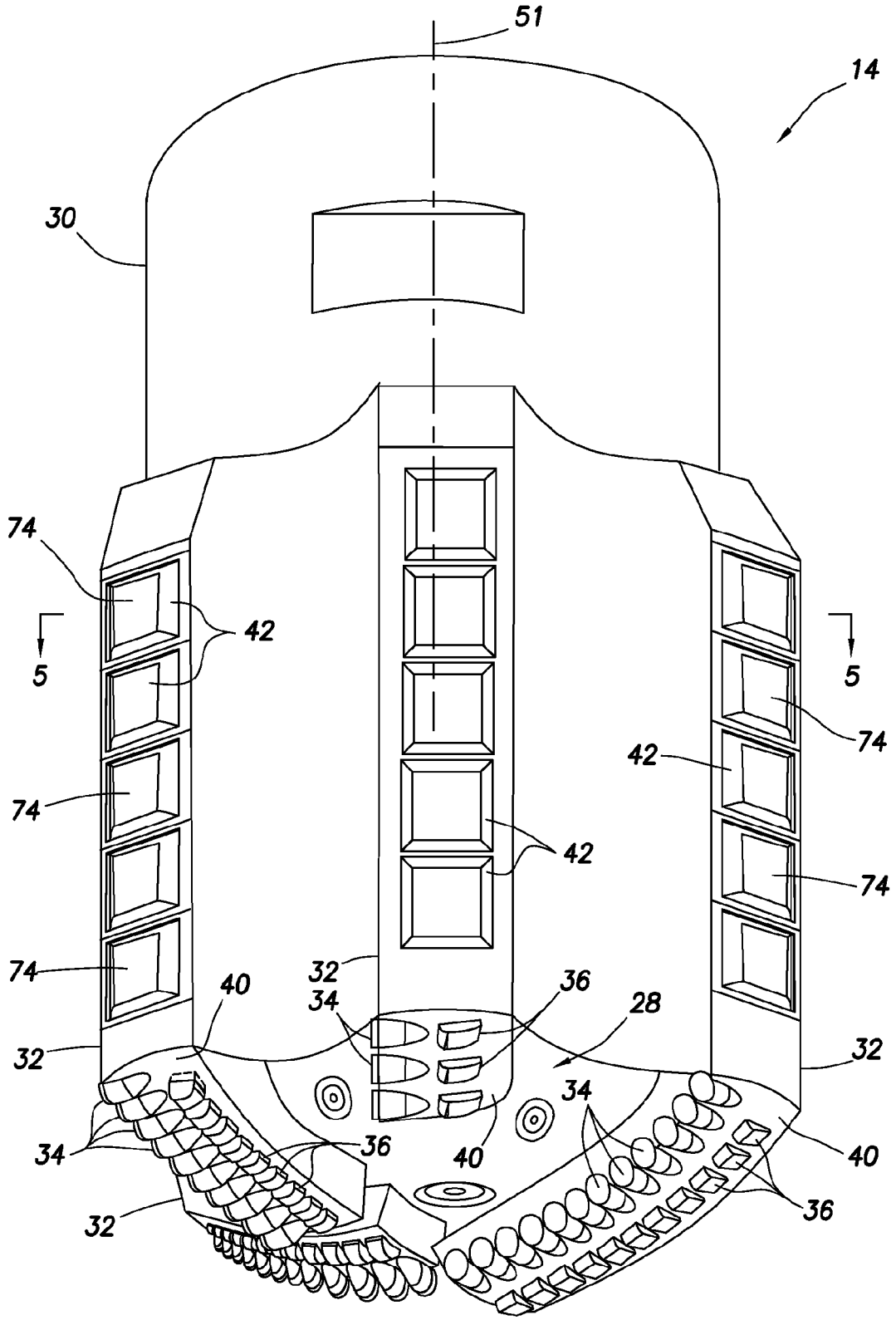
FIG. 2 is a representative elevational view of a drill bit which may be used in the system and method of FIG. 1, and which may embody the principles of this disclosure.

Referring additionally now to FIG. 2, an enlarged scale view of the drill bit 14 is representatively illustrated. The drill bit 14 may be used in the FIG. 1 system 10 and method, or it may be used in other systems or methods.

In the FIG. 2 example, the drill bit 14 includes a body 28 having an upper connector 30 for connecting at a lower end of the drill string 16 (e.g., by threading). Extending radially and downwardly outward from the body 28 are blades 32.

The blades 32 depicted in FIG. 2 extend straight longitudinally along sides of the body 28, however, in other examples the blades could extend helically, or in any other direction. Any number, shape, combination or orientation of the blades 32 may be used, in keeping with the scope of this disclosure.

The drill bit 14 example shown in FIG. 2 is configured for cutting while the drill bit is rotated. In other examples a drilling tool incorporating the principles of this disclosure may not rotate in a well.

Secured to the blades 32 are cutters 34 which cut into the formation 24 when the drill bit 14 is rotated while in contact with the formation. In this example, the cutters 34 comprise polycrystalline diamond compact (PDC) cutters, but any other types of cutters may be used, in keeping with the scope of this disclosure.

The cutters 34 may be distributed on the drill bit 14 in any manner, for example, on an end of the drill bit, on an outer diameter of the drill bit, etc. It is not necessary for the cutters 34 to be positioned on the blades 32. Indeed, some drill bits incorporating the principles of this disclosure may not include the blades 32.

Although "fixed" cutters 34 are depicted in FIG. 2, in other examples the cutters could be on moving components (such as roller cones, etc.), or the cutters could be otherwise movably mounted on the drill bit 14. In one example described more fully below, the cutters 34 are displaceable relative to the body 28, to thereby change a depth of cut of the cutters. The cutters 34 can also be displaced to assist in steering the drill bit 14 (e.g., by altering the depth of cut on one side of the drill bit).

The FIG. 2 drill bit 14 example also includes depth of cut control pads 36. The pads 36 contact a formation surface 38 (see FIG. 1) being cut by the cutters 34, and thereby limit a depth of cut of the cutters into the formation 24.

The pads 36 are depicted in FIG. 2 as being positioned on a surface 40 of each blade 32, behind and radially offset from the cutters 34 in a direction of rotation of the drill bit 14. However, other positions of the pads 36 may be used, in keeping with the principles of this disclosure.

For example, the pads 36 could be positioned in front of (e.g., leading) the cutters 34, and/or adjacent the cutters, etc. Thus, the scope of this disclosure is not limited to any particular positions of the pads 36, or any particular positions of the pads relative to the cutters 34.

In an example described more fully below, the depth of cut control pads 36 can be displaced while the drill bit 14 is downhole (in the wellbore 12), and in some cases while the drill bit is cutting into the formation 24. In this manner, the depth of cut of the cutters 34 into the formation 24 can be adjusted downhole, in response to a change in any of a number of different drilling parameters. The pads 36 can also be displaced to assist in steering the drill bit 14 (e.g., by altering the depth of cut on one side of the drill bit).

Gauge pads 42 are also distributed along sides of the blades 32. A drill bit "gauge" is the maximum outer diameter swept by its cutting surfaces. Since the FIG. 2 drill bit 14 is not exactly cylindrical, its gauge corresponds to twice a maximum lateral (radial) extent of its outermost cutter(s) 34.

In an example described more fully below, the gauge pads 42 are displaceable relative to the drill bit body 28, to thereby adjust the lateral gauge dimension of the drill bit 14. This can be used to prevent lateral deflection of the drill bit 14 in the wellbore 12, with the gauge pads 42 contacting a wall 44 of the wellbore 12 (see FIG. 1) as the drill bit rotates.

The gauge pads 42 can also be displaced to assist in steering the drill bit 14 (e.g., by deflecting the drill bit toward one lateral side of the wellbore 12). In this aspect, the gauge pads 42 closest to the connector 30 can have the most influence on a steering performance (e.g., radius of curvature) while drilling the wellbore 12. In that case, perhaps only the gauge pads 42 closest to the connector 30 may be extended, and extension of the gauge pads may be variably and individually controlled to achieve and maintain a desired steering performance, etc.

If a "point the bit" (instead of, or in addition to, a "push the bit") steering capability is desired, then all of the gauge pads 42 closest to the connector 30 can be extended. This provides a "pivot" close to the connector 30, which is especially desirable for long gauge bits of the type frequently used in directional drilling.

Referring additionally now to FIGS. 3A & B, a cross-sectional view of one example of a depth of cut control device 46 is representatively illustrated. The device 46 may be used in the drill bit 14 to displace the depth of cut control pads 36, or the device may be used in other drill bits.

The pad 36 depicted in FIGS. 3A & B includes a depth of cut control surface 48 which contacts the formation surface 38 being cut by the cutters 34. The surface 48 bears against the surface 38 as the drill bit 14 is rotated, thereby limiting a depth to which the associated cutter(s) 34 cut into the formation 24.

By varying a distance by which the surface 48 extends outward from the blade surface 40, the depth of cut can be correspondingly inversely varied (the depth of cut decreases as the extension of the surface 48 from the surface 40 increases). Note that, in FIG. 3A the surface 48 is closer to the surface 40, as compared to in FIG. 3B.

The device 46 also includes a shape altering material 50 which displaces the pad 36 between its FIGS. 3A & B positions. Preferably, the material 50 comprises a shape memory material which changes shape in response to a certain change in temperature. Suitable shape memory materials include NiTi alloys (such as Nitinol, etc.), CuAlNi alloys, etc. Any type of shape memory material may be used, in keeping with the scope of this disclosure.

In other examples, other types of shape altering materials may be used. For example, magnetostrictive or magnetorheological materials, electrostrictive or electrorheological materials, piezoceramics, piezocrystals, etc., may be used.

In still further examples, a shape altering material may not be used to displace the depth of cut control pad 36. Hydraulics or other means to displace the pad 36 could be used. Thus, it will be appreciated that the scope of this disclosure is not limited to any of the details of the device 46 described here or depicted in the drawings.

As mentioned above, the material 50 may change shape due to a change in temperature. This change in temperature can be due to a change in drilling conditions downhole. For example, if the drill bit 14 is cutting into an increased hardness formation 24, or the rotational speed of the drill bit increases, or the weight on the bit increases, etc., increased energy dissipated downhole can increase the temperature of the bit (and the surrounding environment).

In response, the material 50 can change shape and decrease the depth of cut of the associated cutter(s) 34 by increasing the distance between the surfaces 40, 48. However, the temperature change is not necessarily due to a change in drilling conditions. In some examples, the temperature change can be controlled independent of other drilling conditions, so that the pad 36 can be displaced to various positions when/if desired.

In one example described more fully below, one or more heaters can be used to selectively heat the material 50 associated with one or more of the pads 36. The heating can also be controlled based on azimuthal positions of the pads 36 relative to a longitudinal axis 51 of the drill bit 14.

That is, certain pads 36 in a certain azimuthal orientation may be retracted, while other pads in other azimuthal orientations may be extended. The particular pads 36 which are retracted or extended changes as the drill bit 14 rotates. In this manner, the depth of cut on one side of the drill bit 14 will be greater than the depth of cut on the other side of the drill bit, so that the drill bit is steered in the azimuthal direction of the greater depth of cut.

In FIGS. 3A & B, the pad 36 is depicted as being separate from the material 50. In this manner, the pad 36 (or at least its surface 48 which contacts the formation 24 during drilling) can be made of a highly abrasion and impact resistant material (such as tungsten carbide, etc.). However, in other examples, the pad 36 and material 50 could be integrally formed (e.g., the pad could be made of the shape altering material), particularly if the material has sufficient abrasion and/or impact resistance.

Referring additionally now to FIGS. 4A & B, cross-sectional views of an example of another depth of cut control device 52 is representatively illustrated. The device 52 may be used with the drill bit 14, or it may be used with other types of drill bits.

In FIG. 4A, the cutter 34 extends outward from the bit surface 40 by a certain distance. In FIG. 4B, the cutter 34 has been displaced outward by the shape memory material 50, so that the distance is increased. Thus, a depth of cut of the cutter 34 is increased by displacing the cutter 34 outward from the drill bit 14.

In practice, the cutter 34 may initially be in the FIG. 4B position. If the drill bit 14 begins to cut into an increased hardness formation, a temperature of the drill bit will increase, and the material 50 will change shape to retract the cutter 34 somewhat into the drill bit body 28.

This will reduce the depth of cut of the cutter 34, which is generally desirable when drilling into an increased hardness formation. By reducing the depth of cut, less torque is required to rotate the drill bit 14, and less vibration is produced.

If using a "two-way" shape memory material for the material 50, the cutter 34 can also be extended when a temperature decrease results from drilling into a reduced hardness formation. In this manner, the depth of cut can be increased for more aggressive cutting into softer formations. A similar result can be obtained by using a "two-way" shape memory material in the device 46 of FIGS. 3A & B.

In the FIGS. 3A-4B examples, the depth of cut control is automatic, in that the depth of cut is adjusted downhole without any commands or other signals being transmitted from a remote location. However, in other examples, control over the changes in the material's 50 shape can be exercised from a remote location (for example, by using a controllable heater to selectively increase and/or decrease a temperature of the material).

Figure 5:
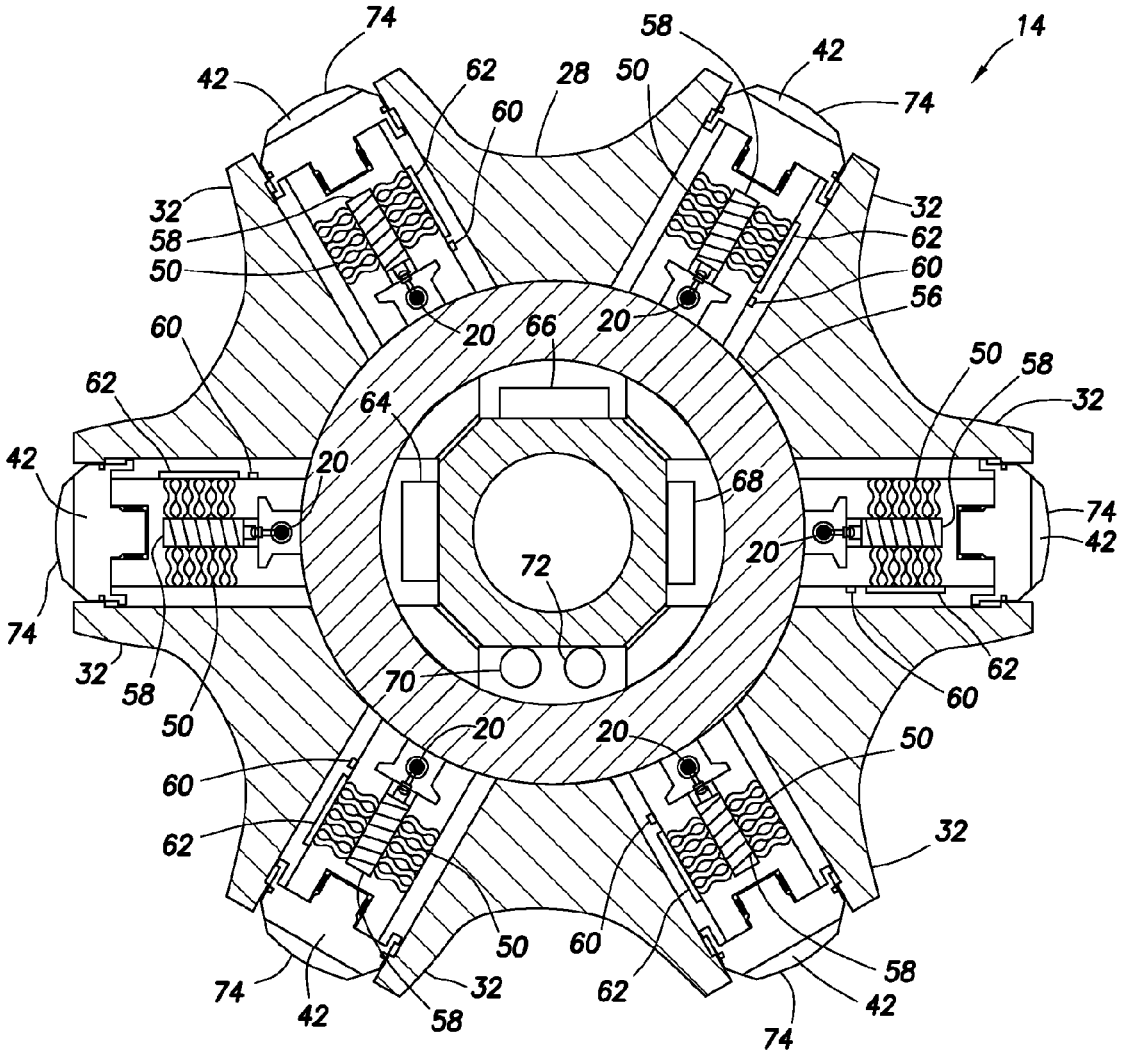
FIG. 5 is a representative cross-sectional view of the drill bit, taken along line 5-5 of FIG. 2.

Referring additionally now to FIG. 5, a cross-sectional view of the drill bit 14 is representatively illustrated. In this view, an example of how the gauge pads 42 can be selectively displaced by the material 50 can be seen. The techniques described here and depicted in the drawings for selectively displacing the gauge pads 42 can also (or alternatively) be used for selectively displacing the cutters 34, the depth of cut control pads 36 and/or pads 54 on the drilling stabilizer 26 (see FIG. 1).

In the FIG. 5 example, the material 50 is in the shape of multiple wave springs connected between each pad 42 and an inner mandrel 56 of the drill bit 14. In this configuration, the material 50 is less rigid and more capable of extending and/or retracting to displace the pad 42.

In other examples, the material 50 could have other shapes. For example, the material 50 could be in the shape of a tube or another hollow and/or resilient structure.

Lines 20 extending in the drill bit 14 are electrically connected to heaters 58 positioned in the material 50. In this example, the heaters 58 comprise electrical resistance heaters, but other types of heaters may be used, if desired.

For example, if the material 50 is in the shape of a hollow structure, then hot fluid (liquid or gas) could be flowed through/into the hollow structure to heat it. Cold fluid could be flowed through/into the hollow structure to cool it, so that it returns to its before heating shape.

A power management module 66 may be used to regulate the supply of electrical power to the heaters 58. The electrical power may be supplied by batteries 70 or the lines 20, and a capacitor 72 may be used to handle large power surges.

When the heaters 58 are supplied with electrical power (or such electrical power is terminated), the tubes of material 50 will change shape, thereby extending or retracting the gauge pads 42. An amount of heat supplied by the heaters 58 can be varied to thereby vary an amount of displacement of the gauge pads 42.

A temperature of the material 50 tubes can be monitored by use of temperature sensors 60. A position of the pads 42 and/or extension of the material 50 can be monitored by use of position sensors 62.

The position sensors 62 may be any type of sensors which can sense a parameter from which the positions of the pads 42 can be determined. For example, the sensors 62 could be strain sensors, linear variable displacement transducers, potentiometers, limit switches, accelerometers, etc.

Additional sensors 64 can be included in the drill bit 14 for use in controlling displacement of the gauge pads 42 (and/or displacement of the cutters 34, the depth of cut control pads 36 or the stabilizer pads 54). For example, the sensors 64 can include a vibration sensor, an acoustic signal sensor, a torque sensor, a weight on bit sensor, an inclination sensor, an azimuthal orientation sensor, wellbore 12 gauge sensor, induction sensors for measuring formation 24 resistivity, rotational speed sensor, stick-slip sensor, bend sensor, etc. Gamma ray sensors and scintillators may be provided in the drill bit 14.

Any drilling parameter can be sensed by sensors 64 in the drill bit 14 (or in other drilling tools, such as the sensors 22 in the drill string 16), in keeping with the scope of this disclosure. Furthermore, the sensors 64 could be positioned in any location(s) in or on the drill bit 14. For example, the sensors 64 could be on the gauge pads 42, so that the sensors are placed in close proximity to, or in direct contact with, the formation 24 when the gauge pads are extended outward.

A control module 66 receives outputs of the sensors 22, 60, 62, 64 and regulates the displacement of the gauge pads 42 to achieve a desired extension of the pads from the blades 32. The desired extension of the pads 42 from the blades 32 can vary as drilling conditions change. For example, if excessive vibration is detected, the surfaces 74 on the gauge pads 42 and/or surfaces 76 on the stabilizer pads 54 could be extended somewhat to maintain contact with the wall 44 of the wellbore 12, the depth of cut control pads 36 could be extended and/or the cutters 34 could be retracted to decrease the depth of cut, etc.

Extension of the gauge pads 42 into contact with the wellbore wall 44 while the drill bit 14 is being rotated can also be used to determine a hardness or strength of the formation 24 being drilled. For example, an increase in torque will result from a gauge surface 74 on the gauge pads 42 contacting the wellbore wall 44, and a biasing force exerted by the material 50 can be regulated by regulating the heat applied to the material. By measuring the torque, the extension of the gauge pads 42 and the biasing force applied to the gauge pads (as well as other parameters, such as rotational speed, weight on bit (if any), etc.), an empirical determination of the strength or hardness of the formation 24 can be obtained.

Another technique for measuring the strength or hardness of the formation 24 is to extend differently shaped gauge pads 42 into contact with the formation. For example, note that the gauge surfaces 74 depicted in FIG. 5 are more curved, as compared to the gauge surfaces depicted in FIG. 2. These differently shaped gauge pads 42 will produce different changes in torque as the drill bit 14 rotates when the pads are extended into contact with the wellbore wall 44. By comparing the different changes in torque, an empirical determination of the strength or hardness of the formation 24 can be obtained.

Different ones of the gauge pads 42 can be extended outward or retracted inward at different times to accomplish a variety of different objectives. For example, the gauge pads 42 on one side of the drill bit 14 can be extended outward farther than the gauge pads on an opposite side of the drill bit, to thereby push the drill bit laterally in the wellbore 12 toward the side with the less-extended gauge pads.

As the drill bit 14 rotates, different ones of the gauge pads 42 will be extended and retracted at different times, in order to maintain a desired lateral offset of the drill bit in the wellbore 12. This will "steer" the drill bit 14, so that the wellbore 12 is curved in the direction of the drill bit's lateral deflection. More or less lateral deflection may be applied to thereby vary a radius of curvature of the wellbore 12.

As another example, the gauge pads 42 closest to the connector 30 (e.g., closest to the remainder of the drill string 16) could be extended more from the drill bit body 28, as compared to the remainder of the gauge pads. In this manner, the more extended gauge pads 42 will provide a beneficial "pivot" against the wellbore wall 44 for rotating the drill bit 14 in a desired direction (e.g., using directional drilling equipment, such as the fluid motor 18 with a bent housing, etc.).

As yet another example, the gauge pads 42 could be extended to vary the torque in the drill string 16. For example, as the gauge pads 42 increasingly bear on the wellbore wall 44, torque in the drill string 16 can increase.

By varying the torque (which can be conveniently measured at the surface) in the drill string 16, data can be transmitted from the drill bit 14 to the surface. By varying the torque in certain predetermined patterns (such as, by amplitude modulation, phase modulation, etc.) corresponding signals can be transmitted.

The stabilizer pads 54 can be actuated in a manner similar to that described above for the gauge pads 42. For example, the drilling stabilizer 26 can be equipped with the material 50, the heaters 58, sensors 60, 62, 64, control module 66, power management module 68, battery 70, capacitor 72, etc., for selectively extending and/or retracting the stabilizer pads 54.

Different ones of the stabilizer pads 54 can be extended and/or retracted at different times. For example, the pads 54 on one side of the stabilizer 26 can be extended outward farther than the pads on an opposite side of the stabilizer, to thereby push the drill string 16 laterally in the wellbore 12 toward the side with the less-extended stabilizer pads. As the drill string 16 rotates, different ones of the stabilizer pads 54 can be extended and retracted at different times, in order to maintain a desired lateral offset of the drill string in the wellbore 12. If the drill bit 14 becomes stuck, the stabilizer pads 54 can be retracted to aid in unsticking the bit.

The positions of any of the drilling components (e.g., cutters 34, depth of cut control pads 36, gauge pads 42, stabilizer pads 54, etc.) can be regulated as needed to maintain any drilling parameter in a desired range or at a desired level. For example, it may be desired to maintain vibration (e.g., as measured by the sensors 22 and/or 64) below a certain maximum level. If actual measured vibration is excessive, the gauge pads 42 can be extended outward into contact with the wellbore wall 44 until the measured vibration is below the maximum level.

In one example, the control module 66 could include a closed loop routine which causes increased electrical power be applied to the heaters 58 when the measured vibration is greater than the maximum level, so that the gauge pads 42 are extended into contact with the wellbore wall 44 (or an increased biasing force is applied from the pads to the wellbore wall). Similarly, the gauge pads 42 can be retracted fully or partially (or the biasing force applied from the pads to the wellbore wall 44 can be reduced) if the torque (e.g., as measured by the sensors 22 and/or 64) is above a maximum level.

The stabilizer pads 54 can also be operated in this manner (e.g., extending the pads to reduce vibration and/or retracting the pads to reduce torque, etc.). The gauge pads 42 and stabilizer pads 54 may also be displaced as needed to achieve and maintain a desired steering performance (e.g., achieving and maintaining a desired radius of curvature in a desired direction, etc.).

Instead of (or in addition to) pads 42, 54, cutters could be extended and/or retracted laterally relative to the drill bit 14 or stabilizer 26. The wellbore wall 44 could be cut by such laterally extendable cutters, thereby underreaming (radially enlarging) the wellbore 12.

The cutters 34 of the drill bit 14 may be retracted, and/or the depth of cut control pads 36 can be extended, in response to measurement of excessive torque or vibration, in order to maintain the torque or vibration within an acceptable range (e.g., below a maximum level). The cutters 34 may be extended, and/or the depth of cut control pads 36 can be retracted, in order to achieve and maintain a desired rate of penetration.

Any drilling tool component can be displaced to any position automatically, in response to measurement of certain drilling parameters, or in response to a command transmitted from a remote location (e.g., via wired, wireless, acoustic, mud pulse, electromagnetic and/or bluetooth telemetry, etc.). Therefore, it will be appreciated that the scope of this disclosure is not limited at all to the displacements of the various drilling tool components (e.g., the cutters 34, depth of cut control pads 36, gauge pads 42 and stabilizer pads 54) described here or depicted in the drawings.

Figure 6:
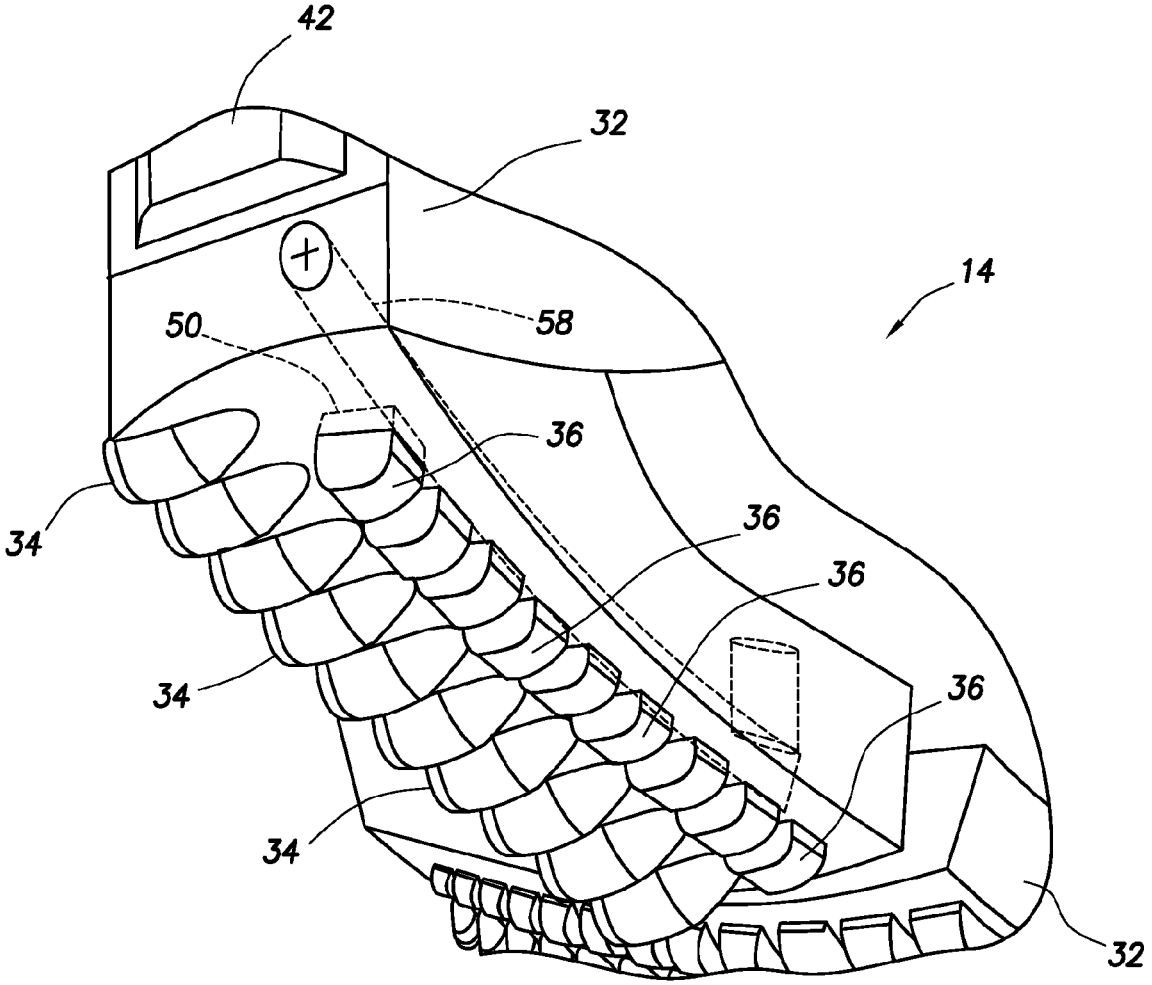
FIG. 6 is an enlarged scale representative view of a blade of the drill bit.

Referring additionally now to FIG. 6, an enlarged scale view of an example of a portion of one of the blades 32 is representatively illustrated. In this example, a single heater 58 is used to increase a temperature of the material 50 underlying multiple ones of the depth of cut control pads 36. In this manner, multiple pads 36 can be displaced together.

Thus, there is not necessarily a one-to-one-to-one relationship between a heater 58, a drilling tool component and the material used to displace the component. Any number of heaters 58 may be used to displace any number of components. Furthermore, a single material 50 may be used to displace multiple components, the material and the components are not necessarily separate elements, etc. Therefore, it will be appreciated that the scope of this disclosure is not limited to any particular number, arrangement or combination of any of the heaters 58, drilling tool components or material 50.

Figure 7:
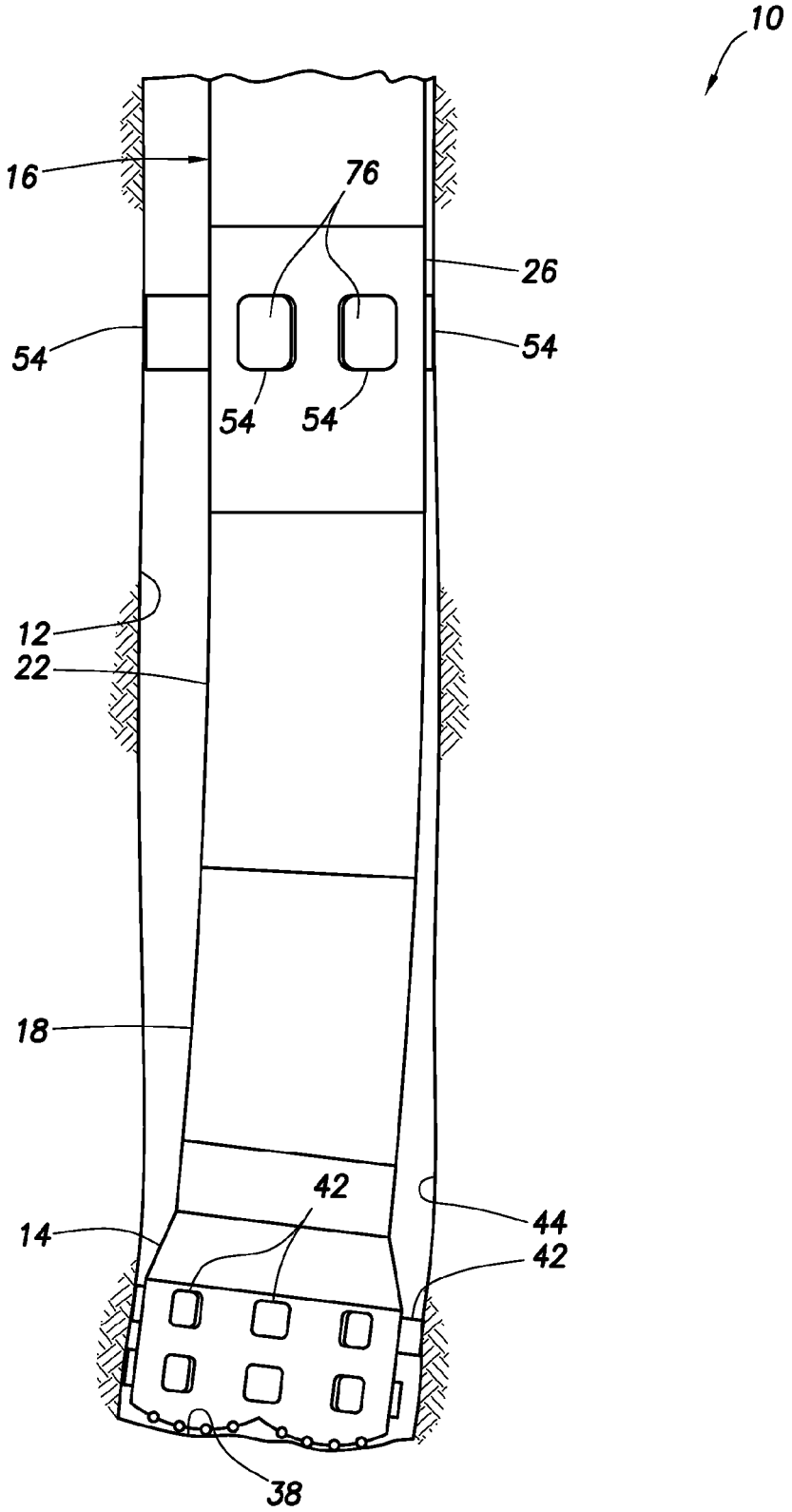
FIG. 7 is a representative view of another example of the well drilling system and method, in which the drill bit is steered.

Referring additionally now to FIG. 7, another example of the system 10 and method is representatively illustrated. In this example, the drill bit 14 can be steered by selectively extending and retracting different ones of the gauge pads 42 and stabilizer pads 54.

The stabilizer pads 54 may be displaced to laterally offset the drill string 16 in the wellbore 12. This technique may be used to help steer the drill bit 14, whether or not the drill string 16 is rotating. If the drill string 16 is rotated, different ones of the stabilizer pads 54 can be extended and retracted, depending on their azimuthal orientation, as the drill string rotates.

The gauge pads 42 can be displaced to laterally offset the drill bit 14 in the wellbore 12. Different ones of the gauge pads 42 can be extended and retracted as the drill bit 14 rotates, depending on the azimuthal orientations of the gauge pads, so that the drill bit is laterally offset by a desired amount. The lateral offset of the stabilizer 26 and/or drill bit 14 can be varied as needed to achieve and maintain a desired lateral offset or a desired curvature of the wellbore 12.

It may now be fully appreciated that the above disclosure provides significant advancements to the arts of constructing and operating drilling tools. In one example described above, a component of a drilling tool can be displaced in response to certain drilling conditions, or to achieve and maintain a desired drilling parameter. Examples of displaceable components include cutters 34, depth of cut control pads 36, gauge pads 42 and stabilizer pads 54, but other types of components may be displaced, in keeping with the scope of this disclosure.

A well drilling system 10 is described above. In one example, the system 10 can comprise a drilling tool (such as, the drill bit 14 or the stabilizer 26, etc.) including at least one component (such as, the sensors 64, the cutters 34, depth of cut control pads 36, gauge pads 42 and/or stabilizer pads 54) which is displaced by a shape memory material 50 which changes shape in response to a temperature change.

The component may comprise a drill bit gauge surface 74 which contacts a wellbore wall 44. The drill bit gauge surface 74 can be displaced while the drilling tool cuts into an earth formation 24.

The drilling tool may comprise a drill bit 14, and the component may comprise a depth of cut control surface 48 which contacts a surface 38 cut by the drill bit 14. The shape memory material 50 may displace the depth of cut control surface 48 relative to a cutter 34 of the drill bit 14.

The component may comprise a stabilizer surface 76 which contacts a wellbore wall 44. The stabilizer surface 76 can be displaced while the drilling tool rotates.

The component may comprise a drill bit cutter 34. The drill bit cutter 34 can be displaced while the drill bit 14 cuts into an earth formation 24.

The temperature change may result from a change in penetrated formation 24 type. The temperature change may result from a change in operation of a heater 58 of the drilling tool.

The heater 58 operation change can be due to a change in torque, a change in vibration, a change in an acoustic signal, and/or a change in steering performance.

The drilling tool may include a position sensor 62 which senses an actual position of the component. The heater 58 can be operated so that the actual position is maintained substantially equal to a desired position.

The drilling tool may include a sensor 22, 64 which senses an actual drilling parameter. The heater 58 can be operated so that the actual drilling parameter is maintained in a desired range.

The component may be displaced in response to a change in a drilling parameter. The drilling parameter can be sensed by a sensor 22, 64 downhole.

The component may comprise a sensor 64 which senses a drilling parameter. The sensor 64 may displace with a pad 42, 54 outward from the drilling tool.

Also described above is a drill bit 14. In one example, the drill bit 14 can include at least one drill bit cutter 34, at least one depth of cut control surface 48 which limits a depth of cut of the drill bit cutter 34, and a material 50 which displaces the depth of cut control surface 48 relative to the drill bit cutter 34, whereby the depth of cut of the drill bit cutter 34 is changed.

The material 50 can comprise a shape memory material which changes shape in response to a temperature change. Other types of shape altering material (e.g., electrostrictive, magnetostrictive, piezoelectric materials, etc.) may be used, if desired. The temperature change may result from a change in operation of a heater 58 of the drill bit 14.

The drill bit 14 can include a position sensor 62 which senses an actual position of the depth of cut control surface 48. Operation of the heater 58 may maintain the actual position substantially equal to a desired position.

The material 50 may displaces the depth of cut control surface 48 outward. The outward displacement may be due to a temperature change in the drill bit 14. The temperature change may be due to increased hardness of an earth formation 24 penetrated by the drill bit 14.

The material 50 can displace the depth of cut control surface 48 inward. The inward displacement may be due to a temperature change in the drill bit 14. The temperature change may be due to reduced hardness of an earth formation 24 penetrated by the drill bit 14.

The depth of cut control surface 48 may be displaced in response to a change in a drilling parameter. The drilling parameter may be sensed by a sensor 22, 64 downhole.

Another drill bit 14 example is described above. In this example, the drill bit 14 can include at least one drill bit cutter 34, and a material 50 which displaces the drill bit cutter 34, whereby a depth of cut of the drill bit cutter 34 is changed.

The drill bit 14 can include multiple cutters 34, and different ones of the cutters 34 may be displaced differently by the material 50 as the drill bit 14 rotates, based on azimuthal positions of the cutters 34 on the drill bit 14, which thereby steers the drill bit 14.

The drill bit 14 can include a position sensor 62 which senses an actual position of the cutter 34. Operation of the heater 58 may maintain the actual position substantially equal to a desired position.

The material 50 may displace the cutter 34 outward. The outward displacement can be due to a temperature change in the drill bit 14. The temperature change may be due to reduced hardness of an earth formation 24 penetrated by the drill bit 14.

The material 50 may displace the cutter 34 inward. The inward displacement can be due to a temperature change in the drill bit 14. The temperature change may be due to increased hardness of an earth formation 24 penetrated by the drill bit 14.

The cutter 34 may be displaced in response to a change in a drilling parameter. The drilling parameter can be sensed by a sensor 22, 64 downhole.

Also described above is a drill bit 14 which, in one example, can include at least one drill bit gauge surface 74 which extends outward from a body 28 of the drill bit 14, and a material 50 which displaces the drill bit gauge surface 74, whereby a lateral dimension of the drill bit 14 is changed.

The drill bit 14 can include multiple gauge surfaces 74. Different ones of the gauge surfaces 74 can be displaced differently by the material 50 as the drill bit 14 rotates, based on azimuthal positions of the gauge surfaces 74 on the drill bit 14, which thereby steers the drill bit 14.

The material 50 may comprise a shape memory material which changes shape in response to a temperature change. The temperature change can result from a change in operation of a heater 58 of the drill bit 14. The heater operation change may be due to a change in torque, a change in vibration, a change in an acoustic signal, and/or a change in steering performance.

The drill bit 14 may include a position sensor 62 which senses an actual position of the gauge surface 74. Operation of the heater 58 can maintain the actual position substantially equal to a desired position. The drill bit 14 can include a sensor 22, 64 which senses an actual drilling parameter, and operation of the heater 58 can maintain the actual drilling parameter in a desired range.

The material 50 may displace the gauge surface 74 outward. The outward displacement can be due to a temperature change in the drill bit 14.

The material 50 may displace the gauge surface 74 inward. The inward displacement can be due to a temperature change in the drill bit 14.

The gauge surface 74 can be displaced in response to a change in a drilling parameter. The drilling parameter may be sensed by a sensor 22, 64 downhole. The sensor 64 can displace with the gauge surface 74.

A drilling stabilizer 26 is also described above. In one example, the drilling stabilizer 26 can include at least one stabilizer surface 76 which extends outward from a body of the drilling stabilizer 26, and a material 50 which displaces the stabilizer surface 76, whereby a lateral dimension of the drilling stabilizer 26 is changed.

The drilling stabilizer 26 can include multiple stabilizer surfaces 76. Different ones of the stabilizer surfaces 76 may be displaced differently by the material 50 as the drilling stabilizer 26 rotates, based on azimuthal positions of the stabilizer surfaces 76 on the drilling stabilizer 26, which thereby steers a drill bit 14.

The drilling stabilizer 26 can include a position sensor 62 which senses an actual position of the stabilizer surface 76. Operation of the heater 58 may maintain the actual position substantially equal to a desired position.

The drilling stabilizer 26 can also include a sensor 64 which senses an actual drilling parameter. Operation of the heater 58 may maintain the actual drilling parameter in a desired range.

The material 50 may displace the stabilizer surface 76 outward or inward. The displacement can be due to a temperature change in the drilling stabilizer 26.

The drilling stabilizer surface 76 can be displaced in response to a change in a drilling parameter. The drilling parameter may be sensed by a sensor 22, 64 downhole. The sensor 64 may displace with the stabilizer surface 76.

A method of controlling a drilling operation is described above. In one example, the method can comprise: configuring a drilling tool with a shape memory material 50 which changes shape in response to a temperature change; and the shape memory material 50 displacing at least one component of the drilling tool during the drilling operation.

The displacing step may be performed in response to a change in a drilling parameter. A sensor 22, 64 may sense the drilling parameter downhole. The drilling parameter may comprise at least one of torque, vibration, acoustic signal, formation characteristic, and steering performance. The sensor 64 may displace with the component.

The drilling parameter may comprise formation 24 hardness, and the method may include sensing the formation 24 hardness by measuring torque due to displacing a first component into contact with a wellbore wall 44. Sensing the formation 24 hardness can also include measuring torque due to displacing a second component into contact with the wellbore wall 44, the first and second components having respective differently shaped surfaces 74, 76 which contact the wellbore wall 44.

Displacement of the component (such as, gauge pads 42 or stabilizer pads 54) can vary torque in a drill string 16, thereby transmitting a signal to a remote location (such as, proximate the earth's surface) via the drill string 16.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well drilling system, comprising:

a drilling tool including at least one component coupled to a shape memory material which changes shape in response to a temperature change to displace the component;

a heater operable to cause the temperature change of the shape memory material;

a first position sensor operable to monitor an extension of the shape memory material; and a second position sensor operable to sense an actual position of the component.

2. The system of claim 1, wherein the component comprises a drill bit gauge surface which contacts a wellbore wall.

3. The system of claim 1, wherein:

the drilling tool comprises a drill bit;

the component comprises a depth of cut control surface which contacts a surface cut by the drill bit; and the shape memory material displaces the depth of cut control surface relative to a cutter of the drill bit.

4. The system of claim 1, wherein the component comprises a stabilizer surface which contacts a wellbore wall.

5. The system of claim 1, wherein:

the drilling tool comprises a drill bit; and the component comprises a drill bit cutter.

6. The system of claim 1, wherein the heater is activated based on at least one of a change in torque, a change in vibration, a change in an acoustic signal, and a change in steering performance.

7. The system of claim 1, wherein the heater is operated so that the actual position is maintained substantially equal to a desired position.

8. The system of claim 1, wherein the drilling tool further comprises a sensor which senses an actual drilling parameter, and wherein the heater is operated so that the actual drilling parameter is maintained in a desired range.

9. The system of claim 1, wherein the component is displaced in response to a change in a drilling parameter.

10. The system of claim 1, wherein displacement of the component varies torque in a drill string and thereby transmits a signal to a remote location via the drill string.

11. A method of controlling a drilling operation, the method comprising:

configuring a drilling tool with a shape memory material which changes shape in response to a temperature change;

displacing the first component of the drilling tool during the drilling operation based on a temperature change of the shape memory material;

monitoring, by a first position sensor, an extension of the shape memory material during the drilling operation; and sensing, by a second position sensor, an actual position of the first component.

12. The method of claim 11, wherein the first component comprises a drill bit gauge surface, and wherein the displacing further comprises the material displacing the drill bit gauge surface into contact with a wellbore wall while the drilling tool cuts into an earth formation.

13. The method of claim 11, wherein the drilling tool comprises a drill bit, wherein the first component comprises a depth of cut control surface, and wherein the displacing further comprises the material displacing the depth of cut control surface relative to a cutter of the drill bit and into contact with a surface cut by the drill bit.

14. The method of claim 11, wherein the first component comprises a stabilizer surface, and wherein the displacing further comprises the material displacing the stabilizer surface into contact with a wellbore wall while the drilling tool rotates.

15. The method of claim 11, wherein the drilling tool comprises a drill bit, wherein the first component comprises a drill bit cutter, and wherein the displacing further comprises the drill bit cutter displacing while the drill bit cuts into an earth formation.

16. The method of claim 11, wherein changing the temperature of the shape memory material is due to at least one of a change in torque, a change in vibration, a change in an acoustic signal, and a change in steering performance.

17. The method of claim 11, wherein the displacing further comprises operating a heater, thereby maintaining the actual position substantially equal to a desired position.

18. The method of claim 11, wherein the drilling tool further comprises a sensor which senses an actual drilling parameter, and wherein the displacing further comprises operating a heater, thereby maintaining the actual drilling parameter in a desired range.

19. The method of claim 11, wherein the displacing is performed in response to a change in a drilling parameter.

20. The method of claim 19, wherein the drilling parameter comprises formation hardness, and further comprising sensing the formation hardness by measuring torque due to displacing the first component into contact with a wellbore wall.

21. The method of claim 20, wherein the drilling tool further includes a second component and the sensing the formation hardness further comprises measuring torque due to displacing the second component into contact with the wellbore wall, the first and second components having respective differently shaped surfaces which contact the wellbore wall.

22. The method of claim 11, wherein the material displaces the first component outward.

23. The method of claim 11, wherein changing the temperature of the shape memory material is due to increased hardness of an earth formation penetrated by the drilling tool.

24. The method of claim 11, wherein the material displaces the first component inward.

25. The method of claim 11, wherein changing the temperature of the shape memory material is due to reduced hardness of an earth formation penetrated by the drilling tool.

26. The method of claim 11, wherein displacement of the first component varies torque in a drill string, thereby transmitting a signal to a remote location via the drill string.

* * * * *